US009470169B2

(12) United States Patent
Watanabe et al.

(10) Patent No.: US 9,470,169 B2
(45) Date of Patent: Oct. 18, 2016

(54) CONTROL DEVICE FOR INTERNAL COMBUSTION ENGINE

(75) Inventors: Hiroshi Watanabe, Toyota (JP); Yasumichi Inoue, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 363 days.

(21) Appl. No.: 13/979,217

(22) PCT Filed: Jan. 20, 2011

(86) PCT No.: PCT/JP2011/050969

§ 371 (c)(1),
(2), (4) Date: Jul. 11, 2013

(87) PCT Pub. No.: WO2012/098661

PCT Pub. Date: Jul. 26, 2012

(65) Prior Publication Data

US 2013/0297188 A1 Nov. 7, 2013

(51) Int. Cl.
*F02D 41/30* (2006.01)
*F02D 41/12* (2006.01)
(Continued)

(52) U.S. Cl.
CPC ..... *F02D 41/30* (2013.01); *F02D 41/047* (2013.01); *F02D 41/12* (2013.01); *F02D 41/123* (2013.01); *F02D 41/126* (2013.01);
(Continued)

(58) Field of Classification Search
CPC ..... F02D 41/126; F02D 41/3094; F02D 41/123; F02D 41/12; F02D 41/3023; F02D 41/3017; F02D 41/3011; F02D 41/047; F02D 41/403; F02D 41/402; F02D 41/30; F02D 41/107; F02D 41/307
USPC ..... 123/325, 326, 431, 481, 332, 493, 123/198 F; 701/104, 105, 112
See application file for complete search history.

(56) References Cited

U.S. PATENT DOCUMENTS 2,557,111 A * 6/1951 Jorgensen ..... F02M 1/02 236/101 C
4,434,769 A * 3/1984 Otobe ..... F02D 41/123 123/492
4,491,115 A * 1/1985 Otobe ..... F02D 41/123 123/325
(Continued)

FOREIGN PATENT DOCUMENTS

CN 1641197 7/2005
CN 101142389 A 3/2008
(Continued)

*Primary Examiner* — Stephen K Cronin
*Assistant Examiner* — Brian Kirby
(74) *Attorney, Agent, or Firm* — Finnegan, Henderson, Farabow, Garrett & Dunner, LLP

(57) ABSTRACT

An object of the present invention is to enhance precision of air-fuel ratio control after return from fuel cut in a control device for an internal combustion engine that has a plurality of fuel injection modes, and performs calculation of a fuel injection amount by a method corresponding to an injection mode in use. For this object, the control device for an internal combustion engine the present invention provides normally determines the injection mode in response to an operation state, but designates a specific injection mode with a higher priority than the injection mode determined in response to the operation state at a time of return from fuel cut. For a predetermined time period after the return from fuel cut, the control device prohibits the injection mode from being changed in response to the operation state, and keeps fuel injection according to the designated specific injection mode.

2 Claims, 3 Drawing Sheets

(51) Int. Cl.
*F02D 41/04* (2006.01)
*F02D 41/10* (2006.01)

(52) U.S. Cl.
CPC ..... *F02D 41/3094* (2013.01); *F02D 41/107* (2013.01); *F02D 41/307* (2013.01)

(56) References Cited

U.S. PATENT DOCUMENTS 4,558,672 A * 12/1985 Boccadoro ..... F02D 41/123 123/325
4,922,877 A * 5/1990 Nagaishi ..... F02D 41/1487 123/492
5,020,495 A 6/1991 Plapp
5,715,796 A * 2/1998 Suzuki ..... F02D 41/008 123/492
5,722,363 A * 3/1998 Iida ..... F02D 41/10 123/305
5,762,043 A * 6/1998 Yoshioka ..... F02D 41/047 123/325
5,928,111 A * 7/1999 Sakakibara ..... F02D 41/022 477/181
6,192,678 B1 * 2/2001 Tachibana ..... F01N 3/22 60/289
6,334,835 B1 * 1/2002 Tanaka ..... F02D 41/126 477/187
6,662,777 B2 * 12/2003 Tsuchiya ..... F02B 17/005 123/299
6,792,912 B2 * 9/2004 Kikuchi ..... F02D 37/02 123/294
6,928,983 B2 * 8/2005 Mashiki ..... F02D 41/008 123/300
6,978,762 B2 * 12/2005 Mori ..... F02D 41/3094 123/430
7,055,503 B2 * 6/2006 Shibagaki ..... F02D 41/08 123/431
7,082,926 B2 * 8/2006 Sadakane ..... F02B 7/02 123/299
7,124,737 B2 * 10/2006 Sadakane ..... F02D 41/3029 123/299
7,185,633 B2 * 3/2007 Watanabe ..... F02D 41/086 123/431
7,216,627 B2 * 5/2007 Ito ..... F02D 41/3094 123/406.47
7,278,397 B2 * 10/2007 Kobayashi ..... F02D 41/047 123/299
7,599,787 B2 10/2009 Hokuto et al.
7,998,027 B2 * 8/2011 Doering ..... F02D 41/0087 477/183
2002/0157381 A1 * 10/2002 Kakuyama ..... F01N 11/007 60/276
2005/0166896 A1 8/2005 Sadakane et al.
2005/0172931 A1 * 8/2005 Mori ..... F02D 41/3094 123/305
2005/0183698 A1 * 8/2005 Yonezawa ..... F02D 35/0046 123/431
2006/0021598 A1 * 2/2006 Nomura ..... F02D 41/3094 123/446
2006/0096576 A1 * 5/2006 Kinose ..... F02D 41/047 123/431
2006/0096577 A1 * 5/2006 Araki ..... F02D 41/30 123/431
2006/0207554 A1 * 9/2006 Nakamura ..... F02D 37/02 123/406.47
2006/0207560 A1 9/2006 Kobayashi
2006/0207563 A1 * 9/2006 Kinose ..... F02D 41/3094 123/431
2006/0272618 A1 * 12/2006 Iwahashi ..... F02D 41/08 123/458
2008/0149073 A1 * 6/2008 Seto ..... F02D 41/126 123/492
2009/0288646 A1 * 11/2009 Demura ..... F02D 41/0042 123/521

FOREIGN PATENT DOCUMENTS

JP 63061740 A * 3/1988
JP 363061740 A * 3/1988
JP 7-279729 10/1995
JP 2002-54488 2/2002
JP 2005-155501 6/2005
JP 2005155501 A * 6/2005
JP 2006-274949 10/2006
JP 2008-19729 1/2008
JP 2008-95532 4/2008
JP 2009197727 A * 9/2009
JP 2009-257192 11/2009
JP 2010242689 A * 10/2010

* cited by examiner

CONTROL DEVICE FOR INTERNAL COMBUSTION ENGINE

CROSS-REFERENCE TO RELATED APPLICATIONS

This application is a national phase application of International Application No. PCT/JP2011/050969, filed Jan. 20, 2011, the content of which is incorporated herein by reference.

TECHNICAL FIELD

The present invention relates to a control device for an internal combustion engine, and more particularly to a control device for an internal combustion engine having a plurality of fuel injection modes.

BACKGROUND ART

There are known internal combustion engines each of which has a plurality of fuel injection modes. As one example of such internal combustion engines, the one that includes a port injection valve and a cylinder injection valve and changes an injection ratio from each of the injection valves is cited, as described in, for example, Japanese Patent Laid-Open No. 2009-257192. Further, an internal combustion engine that can change the number of times of injection in a port injection type internal combustion engine is cited as one of such internal combustion engines.

In the internal combustion engine having a plurality of injection modes, an optimal injection mode is determined in accordance with the operation states such as an engine speed and a load. When the injection mode is changed, the calculation method of the fuel injection amount is also changed in response thereto. This is because the easiness of vaporization and advancement of vaporization of an injected fuel differ in accordance with the injection mode. For example, in the case of cylinder injection, the fuel injection amount can be determined on the assumption that most of the fuel injected from the fuel injection valve is provided for combustion. In contrast with this, in the case of port injection, the fuel injection amount needs to be determined with consideration given to the ratio of the amount of the fuel that adheres to the wall surface of the port to the fuel injection amount, and the ratio of the amount of the vaporized fuel to the adhering fuel amount. The fuel injection amounts are calculated by the methods corresponding to the injection modes like this, and thereby, control precision of the air-fuel ratio can be kept, no matter what injection mode is selected.

However, concerning the return time from fuel cut, the control precision of the air-fuel ratio cannot be always kept with the conventional control method for an internal combustion engine. During implementation of fuel cut, phenomena occur, such as a decrease of an adhering fuel by being taken out by air, and reduction of temperature of the valve and the wall surface, which do not occur during fuel injection. As a result, before fuel cut, and at a return time from the fuel cut, parameters for use in calculation of the fuel injection amount significantly change. In the conventional control method for an internal combustion engine, the injection mode is determined as a natural consequence in accordance with the operation conditions, and therefore, there are the possibilities that the injection mode differs at each return from fuel cut, and that the injection mode is changed immediately after return. For example, in the control device described in Japanese Patent Laid-Open No. 2009-257192, the ratio of port injection and the ratio of cylinder injection are changed in response to the operation state at the time of return from fuel cut. If the injection mode differs, the calculation method of the fuel injection amount using the aforementioned parameters also differs, and if the injection mode is changed halfway, the calculation method of the fuel injection amount is further complicated. Therefore, with the conventional control method for an internal combustion engine, there is concern of being incapable of correctly calculating the fuel injection amount necessary to keep the air-fuel ratio optimal in the case of return from fuel cut.

CITATION LIST

Patent Literature

Patent Literature 1: Japanese Patent Laid-Open No. 2009-257192

SUMMARY OF INVENTION

The present invention has an object to enhance precision of air-fuel ratio control after return from fuel cut in a control device for an internal combustion engine that has a plurality of fuel injection modes, and performs calculation of a fuel injection amount by a method corresponding to an injection mode in use. In order to attain the object like this, the present invention provides a control device for an internal combustion engine as follows.

A control device for an internal combustion engine that the present invention provides basically determines an injection mode in response to an operation state, but at a time of return from fuel cut, the control device designates a specific injection mode with a higher priority than the injection mode which is determined in response to the operation state. For a predetermined time period after the return from fuel cut, the control device prohibits change of the injection mode corresponding to the operation state. The injection mode at the time of return from fuel cut is fixed to the specific injection mode like this, whereby complication of calculation of the fuel injection amount can be avoided, and it becomes easy to correctly calculate the fuel injection amount necessary to keep the air-fuel ratio optimal.

Further, when the internal combustion engine which is a control target is an internal combustion engine having a port injection valve and a cylinder injection valve, the present control device determines a possibility of engine stall at the time of return from fuel cut, and when there is a possibility of engine stall, the present control device can designate an injection mode in which an injection ratio by the cylinder injection valve is high as the injection mode at the time of return from fuel cut. According to this, engine stall which easily occurs at the time of return from fuel cut can be also prevented while precision of the air-fuel ratio control is kept.

DESCRIPTION OF EMBODIMENTS

Embodiment 1

Hereinafter, embodiment 1 of the present invention will be described with reference to the drawings.

Figure 1:
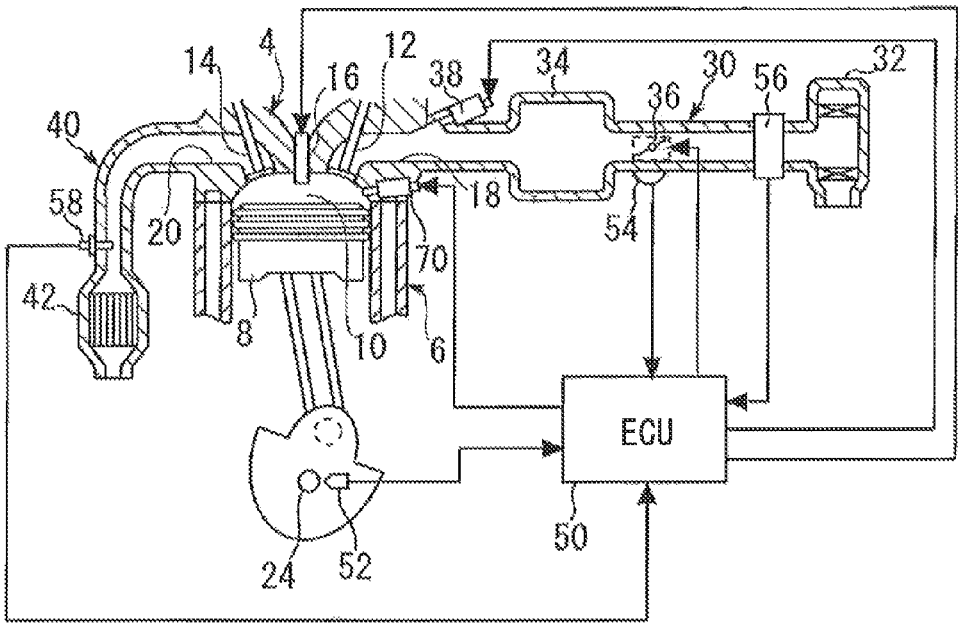
FIG. 1 is a schematic diagram showing a configuration of an internal combustion engine to which a control device of embodiment 1 of the present invention is applied.

FIG. 1 is a diagram showing a schematic configuration of an internal combustion engine (hereinafter, simply called an engine) to which a control device as embodiment 1 of the present invention is applied. The engine shown in FIG. 1 is a spark ignition type four-cycle reciprocating engine. The engine includes a cylinder block 6 in which a piston 8 is disposed, and a cylinder head 4 assembled to the cylinder block 6 in an inside thereof. A space from a top surface of the piston 8 to the cylinder head 4 forms a combustion chamber 10, and an intake port 18 and an exhaust port 20 are formed in the cylinder head 4 so as to communicate with the combustion chamber 10. At a connecting portion of the intake port 18 and the combustion chamber 10, an intake valve 12 that controls a communication state of the intake port 18 and the combustion chamber 10 is provided, and at a connecting portion of the exhaust port 20 and the combustion chamber 10, an exhaust valve 14 that controls a communication state of the exhaust port 20 and the combustion chamber 10 is provided. Further, to the cylinder head 4, an ignition plug 16 is attached to protrude into the combustion chamber 10 from a top portion of the combustion chamber 10.

To the intake port 18 of the cylinder head 4, an intake passage 30 for introducing air into the combustion chamber 10 is connected. At an upstream end of the intake passage 30, an air cleaner 32 is provided, and air is taken into the intake passage 30 via the air cleaner 32. An air flow meter 56 that outputs a signal corresponding to an intake amount of air is disposed downstream of the air cleaner 32. A downstream portion of the intake passage 30 branches into each cylinder (each of the intake ports 18), and at a branch point thereof, a surge tank 34 is provided. A throttle 36 is disposed upstream of the surge tank 34 of the intake passage 30. To the throttle 36, a throttle sensor 54 that outputs a signal corresponding to an opening thereof is annexed.

Further, to the exhaust port 20 of the cylinder head 4, an exhaust passage 40 for exhausting combustion gas generated by combustion in the combustion chamber 10 as exhaust gas is connected. The exhaust passage 40 is provided with a catalyst 42 for purifying the exhaust gas. An air-fuel ratio sensor 58 that outputs a signal corresponding to an air-fuel ratio of exhaust gas is disposed upstream of the catalyst 42 in the exhaust passage 40.

The engine of the present embodiment is configured as a dual injection system including two injection valves 38 and 70 in each cylinder. The injection valve 38 at one side is a port injection valve provided in the vicinity of the intake port 18 of the intake passage 30, and is configured to inject a fuel into the intake port 18. The injection valve 70 at the other side is a cylinder injection valve provided in the cylinder head 4 to face an inside of the combustion chamber 10, and is configured to inject a fuel directly into the combustion chamber 10. In such a dual injection system, injection allocation ratios of the fuel injection amount from the port injection valve 38 and the fuel injection amount from the cylinder injection valve 70 can be optionally set.

The engine of the present embodiment includes an ECU (Electronic Control Unity 50 as a control device thereof. To an output side of the ECU 50, various actuators such as the port injection valve 38, the cylinder injection valve 70, the throttle 36 and the ignition plug 16 which are described above are connected. To an input side of the ECU 50, various sensors such as a crank angle sensor 52 that outputs a signal corresponding to a rotation angle of a crankshaft 24 are connected, in addition to the air flow meter 56, the throttle sensor 54 and the air-file ratio sensor 58 which are described above. An operation state of the engine can be determined from signals of these sensors. The ECU 50 receives the signals from these sensors and operates the respective actuators in accordance with a predetermined control program.

One kind of engine control that is performed by the ECU 50 is fuel injection control. According to the configuration of the engine of the present embodiment, three injection modes are selectable, which are a mode of injecting a whole of a necessary fuel from the port injection valve 38, a mode of injecting the whole of the necessary fuel from the cylinder injection valve 70, and a mode of injecting a part of the fuel from the port injection valve 38 and injecting the remaining fuel from the cylinder injection valve 70. ECU 50 determines the injection mode in response to the operation state of the engine, and operates any one of the two injection valves 38 and 70 in accordance with the determined injection mode. Further, the ECU 50 changes a calculation method of the fuel injection amount in response to the determined injection mode. Note that the engine with the configuration shown in FIG. 1 is a well known, and the presence of the aforementioned three injection modes, and the calculation method of the fuel injection amount in each of the injection modes are also well known. Accordingly, the description of the calculation method of the fuel injection amount of each of the injection modes will be omitted in the present description.

In the fuel injection control by the ECU 50, fuel injection control (hereinafter, FC return control) that is implemented at a time of return from fuel cut is included. The FC return control is implemented in parallel in a routine different from a routine for determining the injection mode in response to the operation state, and a routine for finally fixing the injection mode to be used. A content of the FC return control which is implemented in the present embodiment can be described in accordance with a flowchart of FIG. 2. Hereinafter, the FC return control of the present embodiment will be described with use of the flowchart of FIG. 2.

Figure 2:
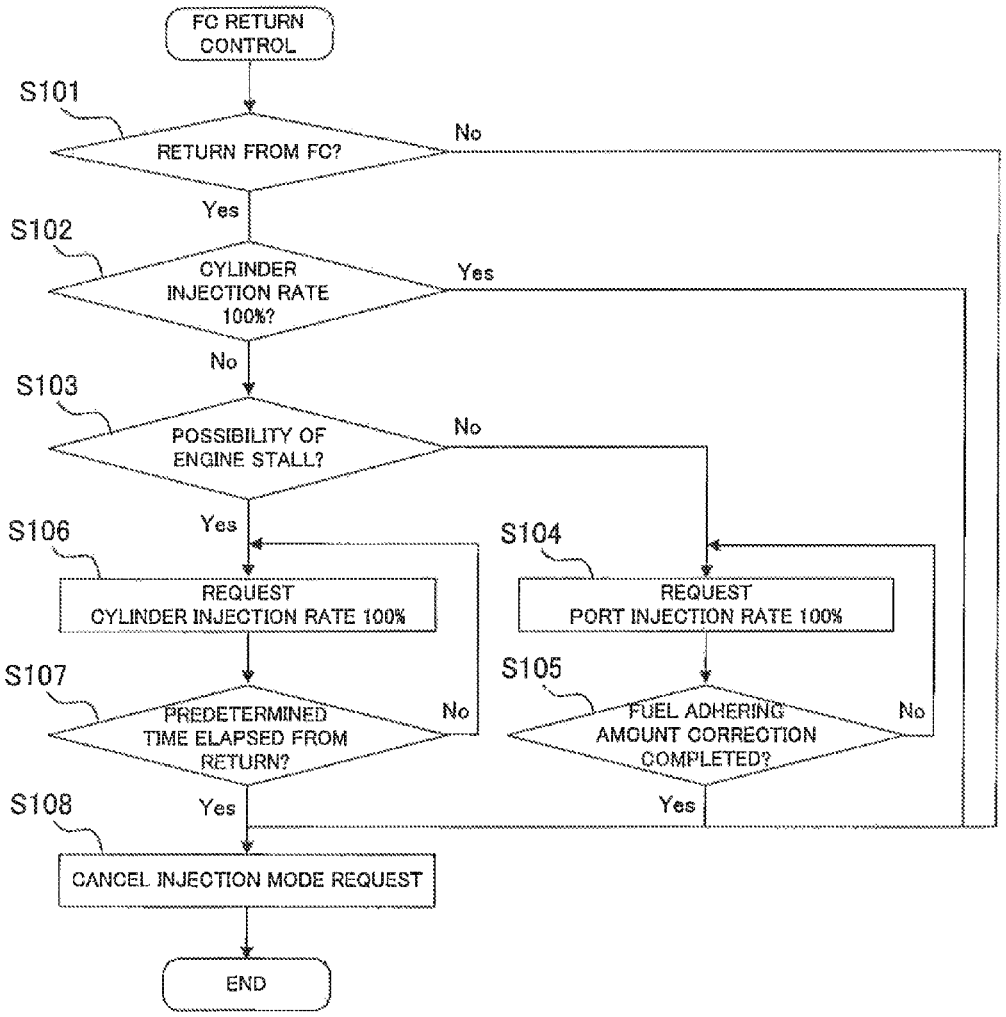
FIG. 2 is a flowchart for explaining FC return control executed in the embodiment 1 of the present invention.

According to the flowchart of FIG. 2, whether it is the return time from fuel cut or not is determined in the first step S101 thereof. The return time from fuel cut means the time when any one of the conditions of return from fuel cut is satisfied. The conditions of the return from fuel cut include the facts that the engine speed declines to a predetermined lower limit engine speed, that an accelerator pedal is depressed, and the like. When it is not the return tune from fuel cut, that is, when it is during execution of fuel cut, and when a certain fixed time elapses after return from fuel cut, a special request concerning the injection mode is not issued (step S108). In this case, the present routine is ended, and the respective injection valves 38 and 70 are driven in accordance with the injection mode which is determined in response to the operation state of the engine.

If the present time corresponds to the return time from fuel cut, the flow proceeds to step S102, where the next determination is implemented. In step S102, it is determined whether or not the injection mode determined from the operation state of the engine is the mode of injecting 100% of the necessary amount of fuel by the cylinder injection valve 70. When the result of the determination of step S102 is affirmative, a special request concerning the injection mode is not issued (step S108). In this case, as determined in accordance with the operation conditions of the engine, the mode of injecting 100% of the necessary amount of fuel by the cylinder injection valve 70 is used as the injection mode at the return time. If the ratio of the cylinder injection is 100%, correction of the fuel injection amount corresponding to the fuel adhering amount is not necessary, and the fuel injection amount necessary to keep the air-fuel ratio optimal can be calculated correctly.

If the result of the determination of step S102 is negative, determination of step S103 is subsequently implemented. In step S103, it is determined whether or not there is the possibility of engine stall when the ratio of port injection is set at 100% at the time of return from fuel cut. More specifically, a time period of implementing fuel cut is compared with a reference time period. Next, the present engine speed is compared with a reference engine speed, and a decline amount per unit time of the engine speed is compared with a reference decline amount. When the time period of implementing fuel cut exceeds the reference time period, and the engine speed is lower than the reference engine speed, or the engine speed abruptly declines by exceeding the reference decline amount, it is determined that there is the possibility of engine stall.

When fuel cut is implemented, as the implementation time period becomes longer, a decline amount of a temperature of the intake valve 12 becomes larger, and the amount of the adhering fuel which is taken out also becomes larger. Therefore, when the injection mode at the time of return from fuel cut is set as port injection, a large fuel injection amount is needed to compensate the adhering fuel, and as a result, the injection time period of the fuel becomes long. In the situation where the engine speed declines, and in the situation where the engine speed abruptly declines, combustion is desired to be started as soon as possible after return from fuel cut. However, in the case of port injection, fuel injection is performed after waiting for the cylinder that can ensure a necessary fuel injection time period, and therefore, there arises the possibility that return from fuel cut cannot be performed quickly and engine stall occurs. Thus, in the present embodiment, control for return from the fuel cut is implemented by different methods in the case with the possibility of engine stall, and the case without the possibility of engine stall.

In the case without the possibility of engine stall, processing of step S104 is implemented. In step S104, the mode of injecting 100% of the necessary amount of fuel by the port injection valve 38 is requested as the injection mode at the return time. In the routine for finally fixing the injection mode for use, the injection mode requested in the present step is designated as a final injection mode for use with a higher priority than the injection mode which is determined in response to the operation state of the engine.

In the engine including the port injection valve 38 as in the present embodiment, the amount of the fuel adhering to the wall surface of the intake port 18 and the intake valve 12 is used as a parameter for calculation of the fuel injection amount. The adhering fuel amount continuously changes while fuel injection is implemented, but when fuel cut is executed, the adhering fuel amount changes to a large extent before and after the execution of fuel cut. At the time of return from fuel cut, the fuel adhering amount needs to be corrected with consideration given to the increase amount of the fuel adhering amount to the intake valve 12 due to the influence of the valve temperature which declines during fuel cut, and the amount of the fuel, which originally adheres to the wall surface of the intake port 18 and the intake valve 12, being taken out by air during fuel cut. The correction amount at this time differs depending on the ratio of the fuel injected by port injection, and therefore, when the injection mode is determined as a natural consequence in response to the operation state, or is changed halfway, the calculation thereof becomes extremely complicated.

In the present embodiment, however, with a higher priority than the injection mode which is determined in response to the operation state of the engine, the mode of injecting 100% of the necessary amount of fuel by the port injection valve 38 is designated as the injection mode at the return time. Further, in the following step S105, it is determined whether or not correction of the fuel adhering amount is completed, and the request of step S104 is continued to be issued until correction of the fuel adhering amount is completed. Namely, at least for the time period until the correction of the fuel adhering amount is completed, the mode of injecting 100% of the necessary amount of fuel by the port injection valve 38 is kept. According to this, complication of the calculation of the fuel injection amount, in particular, the calculation of the correction amount corresponding to the fuel adhering amount is avoided, and therefore, it becomes easy to calculate the fuel injection amount necessary to keep the air-fuel ratio optimal correctly. Thereafter, at the time point when the correction of the fuel adhering amount is completed, the request of step S104 concerning the injection mode is cancelled (step S108).

When the result of the determination of step S103 is affirmative, that is, when there is the possibility of engine stall, processing of step S106 is performed. In step S106, the mode of injecting 100% of the necessary amount of fuel by the cylinder injection valve 70 is requested as the injection mode at the return time. Further, in the following step S107, it is determined whether or not a predetermined time elapses from the return from fuel cut, and until the predetermined time elapses, the request of step S106 is continued to be issued. Namely, during the time period from return from fuel cut until the predetermined time elapses, the mode of injecting 100% of the necessary amount of fuel by the cylinder injection valve 70 is kept. The predetermined time in this case is set to a time period which is necessary and sufficient for recovery of the valve temperature which is declined with implementation of fuel cut. According to this, correction of the fuel injection amount corresponding to the fuel adhering amount becomes unnecessary, and therefore, it becomes easy to correctly calculate the fuel injection amount necessary to keep the air-fuel ratio optimal. Furthermore, it becomes possible to avoid engine stall by advancing the start timing of combustion by cylinder injection. Thereafter, at a time point the predetermined time elapses, the request of step S106 concerning the injection mode is cancelled (step S108).

Embodiment 2

Next, embodiment 2 of the present invention will be described with reference to the drawings.

A control device as embodiment 2 of the present invention differs from embodiment 1, and is applied to a port injection type engine, that is, an engine that includes only a port injection valve, but does not have a cylinder injection valve. In the engine of the present embodiment, two modes that are a mode of implementing port injection one time in one cycle, and a mode of implementing port injection by dividing the port injection into two times in one cycle are selectable. An ECU that is the control device of the engine determines an injection mode in accordance with an operation state of the engine, and operates the port injection valve in accordance with the injection mode which the ECU determines. Further, the ECU changes a calculation method of a fuel injection amount in response to the injection mode that the ECU determines.

The ECU implements FC return control as a part of fuel injection control. A content of the FC return control which is implemented in the present embodiment can be described according to a flowchart of FIG. 3. Hereinafter, the FC return control of the present embodiment 1, will be described with use of the flowchart of FIG. 3.

Figure 3:
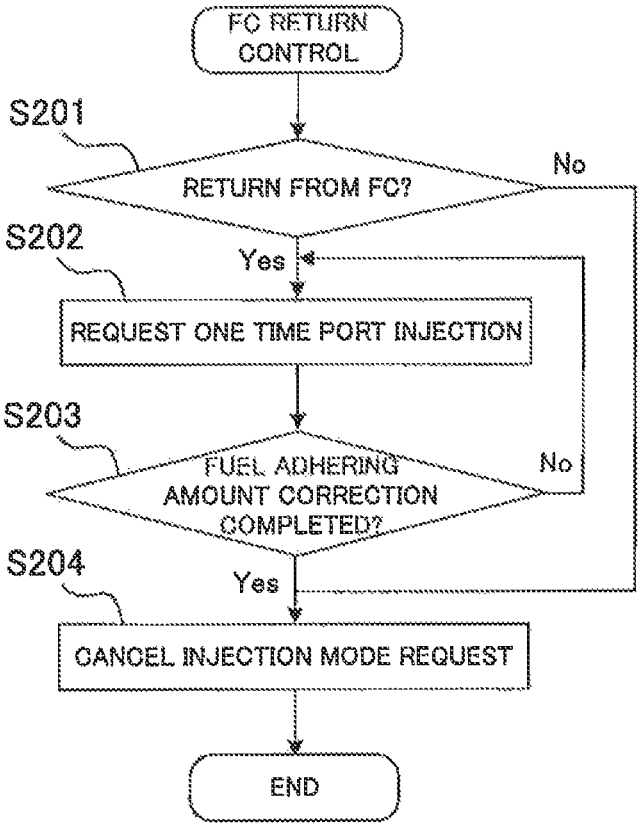
FIG. 3 is a flowchart for explaining FC return control executed in embodiment 2 of the present invention.

According to the flowchart of FIG. 3, whether it is a return time from fuel cut or not is determined in the first step S201 thereof. When it is not the return time from fuel cut, namely, when it is during execution of fuel cut, or when a certain fixed time elapses after return from fuel cut, a special request concerning the injection mode is not issued (step S204). In this case, the present routine is finished, and the port injection valve is driven in accordance with the injection mode which is determined in response to the operation state of the engine.

In contrast with this, if the present time corresponds to the return time from fuel cut, processing of step S202 is implemented. In step S202, as the injection mode at the return time, the mode of implementing port injection one time in one cycle is requested. In the routine for finally fixing the fuel mode for use, with a higher priority than the injection mode which is determined in response to the operation state of the engine, the injection mode requested in the present step is designated as a final injection mode for use. Subsequently, while port injection is implemented one time in one cycle, correction of the fuel adhering amount which significantly changes during fuel cut is performed. Further, in the subsequent step S203, it is determined whether or not correction of the fuel adhering amount is completed, and the request of step S202 is continued to be issued until correction of the fuel adhering amount is completed. Namely, at least for the time period until correction of the fuel adhering amount is completed, the mode of implementing port injection one time in one cycle is kept. According to this, complication of the calculation of the fuel injection amount, in particular, the calculation of the correction amount corresponding to the fuel adhering amount is avoided, and therefore, it becomes easy to correctly calculate the fuel injection amount necessary to keep the air-fuel ratio optimal. Thereafter, at a time point when the correction of the fuel adhering amount is completed, the request of step S202 concerning the injection mode is cancelled (step S204).

Miscellaneous

One of the features of the present invention lies in the point that the injection mode is not determined as a natural consequence in response to the operation state at the time of return from fuel cut, but a specific injection mode set in advance is designated. Accordingly, the injection modes at the time of return from fuel cut which are selected in the aforementioned embodiments are only examples, and other injection modes may be set as the injection mode at the time of return from fuel cut. For example, in the case of the engine having the port injection valve and the cylinder injection valve, the injection mode in which the injection ratio of the port injection and the cylinder injection become a specific ratio (for example, 50:50) can be adopted as the injection mode at the return time. Further, a mode of implementing port injection predetermined times in one cycle may be adopted as the injection mode at the return time, and a mode of implementing cylinder injection predetermined times in one cycle may be adopted as the injection mode at the return time. In the case of the engine having the port injection valve, a mode of implementing port injection a plurality of fixed times can be adopted as the injection mode at the return time, other than the mode of implementing port injection one time in one cycle.

DESCRIPTION OF REFERENCE NUMERALS

10 Combustion chamber
12 Intake valve
18 Intake port
38 Port injection valve
50 ECU
70 Cylinder injection valve

The invention claimed is:

1. A control device for an internal combustion engine that has a port injection valve and a cylinder injection valve, and has a plurality of fuel injection modes in which injection allocation ratios of a fuel injection amount from the port injection valve and a fuel injection amount from the cylinder injection valve are different, comprising:

injection mode determining means configured to determine an injection mode in response to an operation state;

specific injection mode designating means configured to determine a possibility of engine stall in a time of return from fuel cut, to always designate a first specific injection mode with a higher priority than determination by the injection mode determining means when there is not the possibility of engine stall, the first specific injection mode being a mode of injecting fuel only by the port injection valve without injecting fuel by the cylinder injection valve, and to always designate a second specific injection mode with a higher priority than determination by the injection mode determining means when there is the possibility of engine stall, the second specific injection mode being a mode of injecting fuel only by the cylinder injection valve without injecting fuel by the port injection valve;

means configured to calculate a fuel adhering amount corresponding to the first or second specific injection mode designated by the specific injection mode designating means at the time of return from fuel cut, and to perform calculation of a fuel injection amount based on the fuel adhering amount;

means configured to cause the port injection valve to inject all of a necessary amount of fuel at the time of return from fuel cut when the first specific injection mode is designated, and to cause the cylinder injection valve to inject all of a necessary amount of fuel at the time of return from fuel cut when the second specific injection mode is designated; and injection mode change prohibiting means configured to prohibit change of the injection mode by the injection mode determining means when the first specific injection mode is designated, at least for a time period until the correction of the fuel adhering amount is completed since the first specific injection mode is designated, and to prohibit change of the injection mode by the injection mode determining means when the second specific injection mode is designated, until a predetermined time period elapses.

2. The control device for an internal combustion engine according to claim 1, wherein the specific injection mode designating means determines that there is a possibility of engine stall, when a time period of implementing fuel cut exceeds a reference time period and engine speed is lower than a reference engine speed, or when the time period of implementing fuel cut exceeds the reference time period and the engine speed abruptly declines by exceeding a reference decline amount.

* * * * *